United States Patent [19]

Johnson, Jr. et al.

[11] 4,232,979

[45] Nov. 11, 1980

[54] PAVEMENT MARKER

[75] Inventors: Glenn W. Johnson, Jr., Summit, N.J.; Sidney A. Heenan, Park Ridge, Ill.

[73] Assignee: Amerace Corporation, New York, N.Y.

[21] Appl. No.: 970,186

[22] Filed: Dec. 18, 1978

Related U.S. Application Data

[63] Continuation of Ser. No. 789,266, Apr. 20, 1977, abandoned, which is a continuation-in-part of Ser. No. 681,860, Apr. 30, 1976, abandoned.

[51] Int. Cl.[3] ..... E01F 9/04

[52] U.S. Cl. ..... 404/16; 428/913; 350/103

[58] Field of Search ..... 404/16, 14, 15, 9; 350/103, 102, 97; 156/98, 99; 428/34, 38, 67, 142, 172, 913; 116/63 R, 63 P

[56] References Cited

U.S. PATENT DOCUMENTS

| | | | |
|---|---|---|---|
| 1,910,791 | 5/1933 | Coppel | 350/97 X |
| 2,046,321 | 7/1936 | Burkhardt | 404/16 |
| 2,065,314 | 12/1936 | Johnson | 404/16 |
| 2,126,224 | 8/1938 | Shaffer | 404/16 |
| 2,256,636 | 9/1941 | Abbott | 404/16 |
| 2,260,498 | 10/1941 | Wise | 404/16 |
| 2,768,858 | 5/1955 | DeShazor | 404/16 |
| 2,991,698 | 7/1961 | Leubaz | 404/16 |
| 3,332,327 | 7/1967 | Heenan | 404/16 |
| 3,516,337 | 6/1970 | Gubeza | 404/16 |
| 3,532,871 | 10/1970 | Shipman | 350/103 X |
| 3,540,282 | 11/1970 | Kohler | 404/16 X |
| 3,587,416 | 6/1971 | Flanagan | 404/9 |
| 3,822,158 | 7/1974 | Hoffman | 404/16 X |
| 3,836,275 | 9/1974 | Finch | 404/13 |
| 3,975,108 | 8/1976 | Suhr | 404/16 |
| 4,064,308 | 12/1977 | Laurin | 428/913 X |

FOREIGN PATENT DOCUMENTS

| | | | |
|---|---|---|---|
| 282288 | 4/1952 | Switzerland | 404/16 |
| 689791 | 4/1953 | United Kingdom | 404/16 |

OTHER PUBLICATIONS

Publication (1975) of the Society of the Plastics Industry, Inc. by W. Hertl, Sec. 9G.

*Primary Examiner*—Nile C. Byers, Jr.

*Attorney, Agent, or Firm*—Ronald A. Sandler; Richard A. Craig

[57] ABSTRACT

Disclosed herein is a pavement marker for engagement with an underlying roadway for providing a marking visible from an oncoming vehicle on the roadway surface. The pavement marker comprises a lens member of light-transmitting synthetic resin including a front face having a light receiving and refracting portion adapted to be inclined at an angle of at least 15° and a rear face having reflex reflective means for reflecting light transmitted through the light receiving and refracting portion back to the source. In one embodiment, the pavement marker has an abrasion-limiting glass sheet having a thickness no greater than about 15 mils fixedly disposed on the light receiving and refracting portion and preferably under compression throughout the expected temperature range to which the pavement marker is exposed in use. In another embodiment, abrasion-limiting members are raised above the light receiving and refracting portion.

9 Claims, 13 Drawing Figures

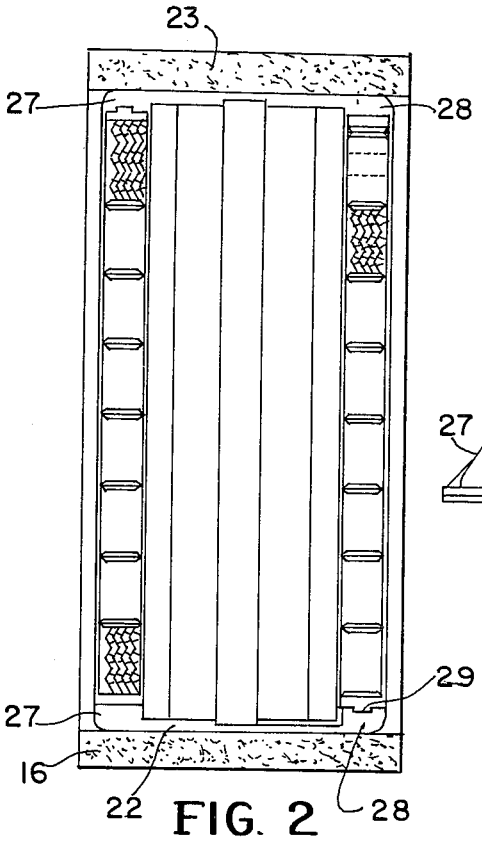
FIG. 2
FIG. 1
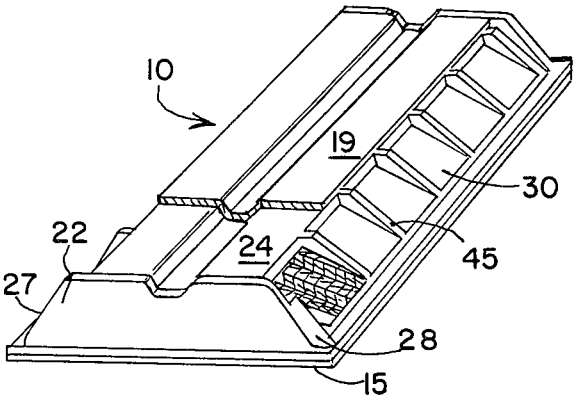
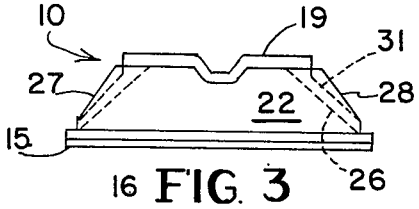
FIG. 3
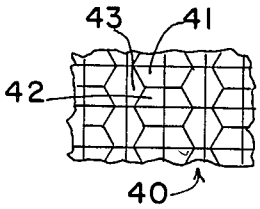
FIG. 4A
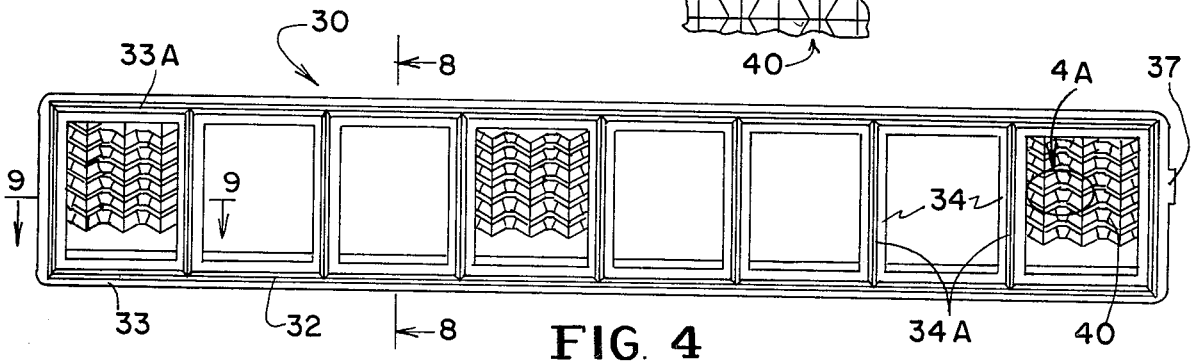
FIG. 4
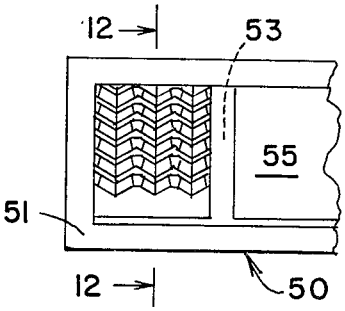
FIG. 11
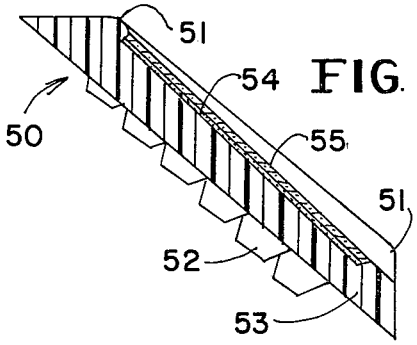
FIG. 12

16°–39°

PAVEMENT MARKER

This is a continuation of application Ser. No. 789,266, filed Apr. 20, 1977 and now abandoned, which is a continuation-in-part of application Ser. No. 681,860, filed Apr. 30, 1976 (now abandoned).

BACKGROUND OF THE INVENTION

In the prior U.S. Pat. No. 3,332,327, assigned to applicants' assignee, there is disclosed a pavement marker adapted to be placed on highways and in which the pavement marker front face is inclined at a predetermined angle to the roadway surface so that a self-cleaning effect is provided by virtue of that predetermined angle, whereby that pavement marker achieves initial high optical efficiency and the optical deterioration arising out of dirt accumulation is substantially reduced by allowing the face to be periodically wiped clean by contact with such vehicle tires. In addition, there is disclosed in that patent a cube-corner reflex reflective optical system in which the cube axes of the cube-corner reflective elements are inclined so as to be substantially coincidental with the nominal incoming refracted ray. Pavement markers made in accordance with the U.S. Pat. No. 3,332,327 and similar to the structure disclosed therein and have been extremely successful in operation, and several millions of them have been installed, primarily in areas where no snowplowing of the roads is required. Such pavement marker, while highly effective as a nighttime signal, is substantially ineffective as a daytime marker, because of the nature of its construction, and, in particular, the large metallized area of the reflective portion thereof, which metallizing is required because of the epoxy fill.

As disclosed in the U.S. Pat. No. 3,332,327, mechanical abrasion decreases when the angle of the front face of the lens portion of the pavement marker is increased; however, as that angle increases, the cleaning action obtained by tire wiping on the front face of the lens decreases. The U.S. Pat. No. 3,332,327 further discloses that there is an optimum balance of adequate wiping and limiting of abrasion, and optimum optical effectiveness is achieved, when the angle of the front face of the lens member is disposed at 30° to the horizontal, with a satisfactory result being obtained where such angle is between 15° and 45°.

However, when such U.S. Pat. No. 3,332,327 pavement markers are used in areas where, in winter months, abrasive materials such as sand and salt are deliberately distributed over the roadway surface, the abrasion problem becomes particularly acute, as the wiping action of the vehicle tires, combined with those abrasive materials, tends to scratch and grind the front face of the lens and diminish the optical effectiveness or the reflex quality of the pavement marker.

Abrasion-resistant coatings which have not had the hardness of glass have been provided in the prior art for coating the surfaces of a plastic object which might be exposed to abrasive elements. But when used to coat reflective pavement markers, such coatings have either failed to provide the necessary abrasion resistance or have required curing temperatures which were so high that they distorted the plastic material of the reflector, thereby resulting in a serious deterioration of the reflector optics.

A paper entitled "Microsheet Glass Coated Plastics" by W. Hertl was published in February, 1975, at the 30th Anniversary Technical Conference, Reinforced Plastics/ Composites Institute, The Society of the Plastics Industry Inc., Section 9-G, Page 1, a copy of which article is filed herewith. The Hertl article discloses methods of laminating thin glass sheets to thick plastic substrates formed of Lexan and Plexiglas, but teaches nothing about the applicability in pavement markers. The adhesives utilized by Hertl required curing at elevated temperatures for at least several hours. Moreover, in contrast to the present invention, Hertl states that in a single side laminate, the plastic (rather than the glass) is in compression. Also, Hertl does not disclose use of a radiation curable curing system. Finally, applicants conceived use of silane and a glass, adhesive resin and reflector laminate for pavement markers prior to publication of the Hertl article.

SUMMARY OF THE INVENTION

Applicants provide a novel structure which has abrasion-resistant and cleaning qualities in a durable pavement marker having several advantages over those discosed by the prior art.

The present invention provides structure for the front face of the lens portion of a pavement marker which structure, by itself, minimizes abrasion, while at the same time permitting sufficient tire action to effect cleaning of the usual dirt and light-impeding film, which dirt and film normally increases as the front face angle is decreased.

It is an object of the present invention to provide in a pavement marker, maximum abrasion resistance to vehicle tires striking the marker, whereby the optical qualities of the face of the reflective portion of the marker are substantially less degraded, thereby increasing the optical efficiency, durability and effectiveness of the marker over a longer time period.

In the preferred version of the invention, the abrasion resistant qualities are applicable to all reflectors, not just pavement markers, particularly where the reflector is to be located in an area where it might be exposed to abrasive conditions.

To the accomplishment of the foregoing and still other objects and advantages, the present invention, briefly summarized, comprises, in a pavement marker providing a marking on a generally horizontally directed roadway surface, the marking being visible from an oncoming vehicle on the roadway, the pavement marker including a lens member of light-transmitting synthetic resin having a front face inclined at an angle of at least 15° to the roadway surface and a rear face having reflex reflective means on at least a portion thereof for reflecting light impinging on the front face back toward the source thereof, the improvement consisting of abrasion-limiting means overlying at least a portion of the front face of the lens member for reducing the degradation of optical efficiency caused by abrasive tire contact on said lens member while allowing adequate cleaning of the pavement marker by tire wiping action whereby the optical efficiency of the pavement marker is enhanced.

It is another object of the present invention to provide, in a pavement marker of the type set forth, abrasion-limiting means comprised of a material more abrasion resistant than the synthetic resin forming said lens member.

An important object of the invention is to provide an improved abrasion-resistant reflective pavement marker formed of a light-transmitting synthetic organic resin, having laminated to the reflector a very thin sheet of transparent glass in such a way that the resulting laminate has optical qualities at least as good as those of the original reflector and is capable of withstanding the impact forces, abrasive materials, chemical elements and temperature and weather extremes experienced on the roadway in use.

It is a further object of the present invention to provide abrasion-limiting means of the type set forth wherein said glass is untempered, and is in the form of a thin sheet having a thickness of about 0.005 inch and is adhesively bonded to said lens member by a resin layer, the thickness of said resin layer being great enough to accommodate the relative changes in size of the glass sheet and the reflector material in use resulting from the different thermal coefficients of expansion thereof.

It is another object of the present invention to provide abrasion-limiting means of the type set forth, which is formed of a more abrasion-resistant and impact-resistant material than that of the lens member.

It is still another object of this invention to provide abrasion-limiting means of the type set forth, which comprises a series of raised members spaced uniformly along the front face of the lens member and extending from the lower edge thereof to the upper edge thereof.

It is a further object of the present invention to provide, in a pavement marker of the character described, a plurality of spaced, raised ridges on the front face of the lens member, the ridges being parallel to the direction of traffic and forming a plurality of channels on the front face of the lens member, the ridges serving to absorb substantially the full impact forces and abrasive contacts caused by tires striking the front face, thereby minimizing abrasion on the other portion of the lens member while adequate cleaning of the lens member is obtained by a combination of high velocity air and rainwater being forced through the channel by passing tires.

In connection with the foregoing objects, another object of this invention is to provide abrasion-limiting means of the type set forth, wherein the plane defined by the raised members is inclined at an ange to the base different from the angle of the front face of the lens member to the base.

Still another object of this invention is to provide a pavement marker of the type set forth which includes means cooperating with the rear surface of the lens member for providing a plurality of hermetically sealed cells, the lens member including a plurality of retrodirective cube-corner-type reflector elements in the portions occupied by the cells, the reflector elements being oriented to reflect light impinging upon the front face of the lens member in the areas corresponding to the cells back toward the source thereof to render the reflector structure highly visible at night.

Further features of the invention pertain to the particular arrangement of the parts of the pavement marker whereby the above-outlined and additional operating features thereof are attained.

The invention, both as to its organization and method of operation, together with further objects and advantages thereof, will best be understood by reference to the following specification taken in connection with the accompanying drawings.

BRIEF DESCRIPTION OF THE DRAWINGS

FIG. 1 is a partially sectioned perspective view of one embodiment of a pavement marker incorporating features of the present invention;

FIG. 2 is a plan view of a pavement marker incorporating features of the present invention;

FIG. 3 is an end elevational view of the pavement marker illustrated in FIGS. 1 and 2;

FIG. 4 is an enlarged view of the rear face of a lens member forming part of a pavement marker incorporating the present invention, taken in a direction perpendicular to the rear face thereof;

FIG. 4A is a fragmentary view, on an enlarged scale, of a portion of the rear reflective surface of the lens member within the circle 4A of FIG. 4, but taken in a direction parallel to the cube axis of the reflector elements;

FIG. 11 is a fragmentary front view of a lens member incorporating a second, preferred embodiment of abrasion-limiting means of the present invention; and FIG. 12 is an enlarged cross-sectional view of the lens member taken along the line 12—12 of FIG. 11, illustrating the front of the lens member at a 45° angle to the base.

DESCRIPTION OF THE PREFERRED EMBODIMENTS

Figures 5, 6, 7, 8, 9, 10:
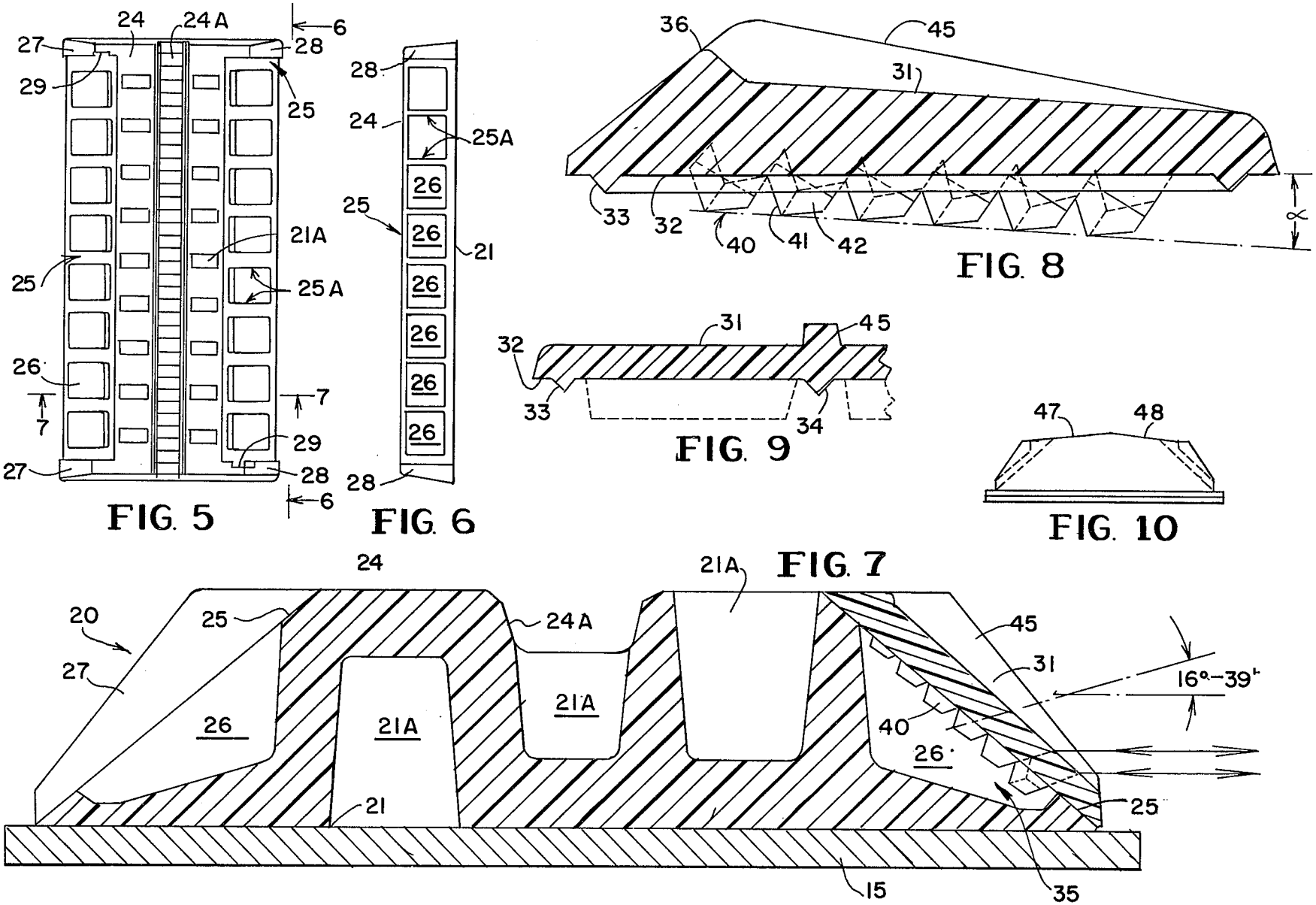
FIG. 5 is a plan view of the base of the pavement marker.
FIG. 6 is a side elevational view of the base, taken in the direction of the line 6—6 in FIG. 5.
FIG. 7 is a greatly enlarged cross-sectional view of the pavement marker, taken substantially along the line 7—7 in FIG. 5.
FIG. 8 is a greatly enlarged cross-sectional view of the lens member taken along the line 8—8 in FIG. 4.
FIG. 9 is an enlarged partial section view of the lens member taken along the line 9—9 of FIG. 4.
FIG. 10 is an end elevational view of a second embodiment of the pavement marker of the present invention.

Referring now to the drawings, one form of a pavement marker incorporating the present invention, is shown in perspective at 10 in FIG. 1. The pavement marker 10 is more completely described in a co-pending United States patent application of Sidney A. Heenan, filed Apr. 30, 1976, entitled "Pavement Marker", Ser. No. 681,859, now abandoned, and a continuation-in-part thereof, Ser. No. 789,265, filed Apr. 20, 1977, both of which applications are assigned to the same assignee as the present application, and the disclosures of which are incorporated herein by reference. It should be understood, however, that the inventions herein also are applicable to other types of reflectors and pavement markers, such as for example, that described in Heenan U.S. Pat. No. 3,332,327, assigned to applicant's assignee.

The pavement marker 10 includes a body or base member 20, of an opaque, light-diffusing synthetic resin having mounted thereon a lens member of light-transmitting synthetic resin generally designated as 30. The base member 20 is substantially solid and is formed as a one-piece member to provide a durable structure capable of withstanding impact forces applied to the pavement marker when it is struck by a tire of an oncoming vehicle.

The pavement marker 10 is employed to provide a marking on a generally horizontal roadway surface, the marking being visible from an oncoming vehicle on the roadway to delineate traffic lanes and for edge delineation, as is well recognized in the art. In addition, the pavement marker 10 incorporating the present invention may be utilized with metal base members of a type illustrated and claimed in a co-pending United States patent application filed Apr. 30, 1976, By Sidney A. Heenan and entitled "Snowplowable Pavement Marker and Method and Apparatus for Installing Same", Ser. No. 681,858, and now abandoned a continuation-in-part thereof, Ser. No. 798,249, filed Apr. 20, 1977, and now abandoned, and a continuation of the latter application, Ser. No. 963,339 filed Nov. 24, 1978, all three of which applications are assigned to the same assignee as the present application.

Referring now more particularly to FIGS. 5, 6 and 7, it will be seen that the base member 20 is formed as a substantially solid one-piece member, having a generally horizontal bottom surface 21. In order to prevent sinks or shrink stresses in molding, the base member 20 may be provided with a plurality of molding recesses 21A (FIGS. 5 and 7). The base member 20 further includes a pair of generally vertically disposed sidewalls 22 and 23 (FIG. 2), and a generally horizontal top wall 24 having a rectangular channel 24A extending from one sidewall 22 to the opposite sidewall 23.

There is provided a pair of inclined support walls 25, disposed at opposite ends of the base member 20, and positioned such that in use, they will be facing the direction of oncoming vehicles. Each of these support walls 25 has a plurality of recesses 26 formed therein, which recesses have substantially rectangular openings intersecting the plane of the wall. The recesses or pockets 26 and the support wall 25 cooperate with the overlying lens member 30 in the manner hereinafter described.

The base member 20 further includes side edges 27 and 28 disposed on the opposite ends of each of the respective side walls 22 and 23, the side edges 27 and 28 extending outwardly beyond the support walls 25, and defining a channel between the opposite side edges and the adjacent support wall 25 disposed therebetween. The base member 20 also includes a tab opening 29 formed in the side walls 22 and 23 adjacent to the respective inclined support walls 25 for purposes of facilitating the alignment of the lens member 30 during attachment thereof to the base member 20.

The lens member 30 which provides the reflective structure for reflecting light back toward the source thereof, thereby rendering the pavement marker highly visible at night, is best illustrated in FIGS. 4, 7, 8 and 9. The lens member 30 is formed of a light-transmitting synthetic resin and includes a suubstantially planar front face 31 having a light receiving and refracting portion and a rear face 32. As illustrated, the lens member 30 is generally rectangular and is intended to be positioned in the channel provided by the side edges 27, 28 and the support wall 25.

The rear face 32 of the lens member 30 is provided with a peripheral edge portion 33 which extends about the entire periphery of the lens member 30 (FIG. 4) and includes a portion 33A which is originally in the form of a generally triangular sealing bead (FIGS. 8 and 9). The rear surface 32 further is provided with a plurality of dividing portions 34, the dividing portions 34 intersecting the peripheral edge portion 33 at equally spaced distances therealong, thereby dividing the lens member into a plurality of generally rectangular areas circumscribed by the peripheral edge portion 33 and the dividing portions 34. As illustrated, the dividing portions 34 originally may include a raised triangular sealing bead 34A, and hereinafter, in the specification, for convenience, the dividing portions 34 may be referred to as "dividing ribs".

The lens member 30 is intended to be positioned over the inclined support wall 25 of the base member 20 and rigidly secured thereto, preferably by ultrasonic welding. When properly positioned, each of the rectangular areas circumscribed by the peripheral edge portion 33 and dividing portions 34 will coextensively overlie and be in registry with the rectangular-shaped openings of the recesses or pockets 26 formed in the support wall 25, while the dividing portions 34 will overlie the dividing portions 25A of the support wall 25.

When the lens member 30 is ultrasonically welded to the base member 20, the sealing beads 33A and 34A become substantially flattened as a result of the energy imparted thereto during the ultrasonic welding process, whereby the peripheral edge portion 33 directly abuts the support wall 25, as best illustrated in FIG. 7, and provides a substantial welded surface area visible through the transparent lens member 30. Similarly, the dividing ribs 34 will become substantially flattened as they are sealed to the underlying dividing walls 25A of the support wall 25.

The lens member 30 also includes an outwardly extending tab 37 adapted to be positioned within the tab opening 29 on the base member 20, and serves as a locator to fix the lens member 30 in position prior to welding. After welding the lens member 30 to the base member 20, each of the dividing wall portions 25A of the support wall 25, and the peripheral portion thereof, in cooperation with the dividing ribs 34 and peripheral edge portion 33, provide a plurality of hermetically sealed cells 35 having a rectangular configuration when viewed in a direction normal to the front face 31.

The pavement marker 10 is provided with a retrodirective cube-corner-type reflector system to effect the signal function of reflecting light back to the driver of an oncoming vehicle whose headlights illuminate the pavement marker. As best seen in FIG. 4, the rear face of the lens member 30, in those rectangular areas circumscribed by the dividing ribs 34 and peripheral edge portion 33, is configurated to provide a plurality of cube-corner-type retrodirective reflector elements 40. In the embodiments illustrated herein, the cube-corner elements 40 are intended to be generally rectangular when viewed in a direction along the line of the cube axis, as best illustrated in FIG. 4A.

Each of the cube-corner elements 40 includes cooperating faces 41, 42 and 43, respectively, the faces intersecting to form first and second and third dihedral angles in a manner well known to those skilled in the art. In the preferred embodiment illustrated, two of the dihedral angles would be on the order of substantially 90° whereas the third dihedral angle would be formed at an angle significantly different from the first and second dihedral angles, so that the light reflected by such cube-corner element is caused to be diverged to a greater extent in one direction than in the other. One such structure is set forth in greater detail in U.S. Pat. No. 3,833,285.

In the illustrated embodiment, the different dihedral angle is formed between those faces designated as 41 and 42 in FIG. 4A, whereby the reflectivity of the reflector will be substantially increased at a greater observation angle.

As seen in FIG. 7, the apices of the cube-corner reflective elements 40 extend beyond the peripheral edge portion 33 and the dividing ribs 34, and into the cell 35, when the lens member 30 is secured to the base member 20. Although in the embodiment illustrated the cells 35 are substantially large and open, it should of course be understood that the pockets 26 may be recessed less deeply than indicated, and, in fact, the apices of the cube corners 40 may contact the underlying surface 26A defining the interior boundary of the recess 26 thereby further to strengthen the lens member 30 and provide additional support therefor as the lens member is contacted by a tire of an oncoming vehicle.

To facilitate installation of the pavement marker an adhesive impact-absorbing material or pad 15 is secured to the bottom surface 21 of the base member 20. The pad 15 may comprise an elastomeric polymeric adhesive material such as, for example, butyl rubber. A protective sheet of release paper 16 is applied to the bottom of the pad. In use, the paper 16 is peeled from the pad 15 and the pavement marker 10 pressed onto the roadway surface. In installation, it may be desirable to use a suitable primer on the roadway to enhance securement of the pavement marker.

As mentioned above, and as disclosed in applicants' assignee's prior U.S. Pat. No. 3,332,327, there is an optimum balance obtained in maintaining optical effectiveness by limiting abrasion and achieving adequate wiping or cleaning of the front face of the marker upon contact by a moving tire. Such optimum balance is achieved when the angle of the front face of the lens member is disposed at approximately 30° to the horizontal, with a satisfactory result being obtained where such angle is approximately from 15° to 45°.

However, the abrasive action on the front face of the marker due to tire contact becomes a much more critical factor than the aforementioned wiping or cleaning action when the pavement marker is used where abrasive materials are purposely placed on the road. Thus, in an area where salt or sand is put on the road during the wintertime, the wiping action by such abrasive materials in contact between the tire and front face of the lens member causes more serious damage to the front face than is the case where those markers are located in other areas of the country where such abrasive materials are not on the roadway. In order to minimize the loss of reflectivity due to abrasion, and to prolong the reflective qualities or optical efficiency of the pavement marker under such conditions, the light receiving and refracting portion front surface 31 of the lens member 30 of the pavement marker incorporating the present invention is preferably inclined at an angle of 45° relative to the horizontal surface 21 of the base member 20. It will be appreciated that the effects of abrasion may be further minimized by increasing the angle of the front face above 45°; however, it is believed that at front face angles above 60 °, the cleaning and wiping action by tire contact will be inadequate to maintain optical effectiveness.

It is also known that the front surface reflection loss due to the inherent nature of the material of the lens member itself, is less at 45° than at 30. As an example, the typical front surface reflection loss of a pavement marker in which the front surface of the lens is located at 30° to the horizontal would be approximately 23%, whereas the front surface loss with the reflector at 45° to the horizontal would only be 12%. Also, by inclining the front face of the marker at 45°, there is a smaller area exposed to contact by automobile tire studs or stones carried in the tire treads, and also the pressure on the front surface is reduced. Further, by inclining the front face of the marker at 45°, it is possible to further reduce the overall height of the marker because there will be a lesser inclination of the cube axis relative to the horizontal than is provided in the prior U.S. Pat. No. 3,332,327, and it will not be necessary to tilt the cube-corner elements as much.

In accordance with the present invention, there is provided abrasion-limiting means which permit an increase of the front face angle thereby improving operation of the pavement marker while at the same time providing a substantial reduction in abrasion on the portions of the lens member having reflective elements thereunder, thereby reducing the degradation of optical efficiency normally caused by abrasive tire contact, while also allowing adequate cleaning of the front face of the lens member by tire action on the lens member, thereby enhancing the optical efficiency of the pavement marker.

In a first embodiment of the invention illustrated, the abrasion-limiting means takes the form of raised ridges 45 raised above the light receiving and refracting portion of the front face 31 of the lens member 30 and extending in use generally parallel to the direction of traffic. The ridges 45 are equally spaced from each other and are respectively disposed directly over and in alignment with and substantially coextensive with the dividing ribs 34 on the back face 32 of the lens member 30, whereby the ridges 45 do not interfere with the operation of the reflex portions 40 of the lens member 30. The ridges 45 may be integrally molded with the lens member 30, or, if desired, they could be made of a more abrasion-resistant material than the lens member and thereafter secured to the lens member 30 by welding or adhesive, thereby to provide further protection for the light receiving and refracting portion of the front surface 31 of the marker 10.

The raised ridges 45 serve to absorb substantially the full impact forces and abrasive contacts caused by tires striking the marker, thereby minimizing abrasion on the light receiving and refracting portion of the front face 31, and particularly from a grinding action by sand or salt being disposed on the roadway. The ridges 45 also serve to form a plurality of channels on the front face 31 of the lens member 30 which permit adequate cleaning of the front face 31 of the lens member 30 by tire action on the lens member 30, which action includes a combination of high velocity air and rainwater being forced through the channels by passing tires. In addition to improved abrasion resistance, the ridges 45 provide structural strength to the lens member 30, further serving to maintain the integrity of the cells 26 and reflector elements 40 under tire impact.

While the ridges 45 have been disclosed as being used with a lens member which includes dividing ribs on the back face thereof, the ridges being respectively disposed directly over and in alignment with the dividing ribs, it will be understood that the raised ridges 45 could also be used with other forms of pavement markers such as that disclosed in the aforementioned U.S. Pat. No. 3,332,327.

As previously described, the side edges 27 and 28 extend outwardly beyond the inclined support walls 25 of the base member 20, and provide a channel between the side edges and the support wall 25 within which is disposed the lens member 30. The side edges 27 and 28 provide further structural support and protection for the lens member 30 adjacent those areas in which the ultrasonic welding occurs at the corners of the markers, thereby serving to substantially protect the integrity of the marker at those points. It will also be noted that the side edges 27–28 and the front edges of the protective ridges 45, lie in the same plane, in effect defining a protective barrier for the front face 31 of the marker 10.

As illustrated, the pavement marker 10 may be provided with a metal cover plate 19 to overlie and protect the entire top wall 24 thereof; the cover plate 19 also extending beyond and overlying the upper edge of the lens member 30, as best seen in FIG. 3. The metal cover plate 19 is intended to be used on those embodiments of the pavement marker 10 which are to be installed in a metal casting and subjected to possible contact by studded snow tires passing over the top of the marker, the cover plate serving to provide additional protection against such members. The cover plate 19 may be adhesively secured to the top wall 24, or, alternatively, a second impact-absorbing pad (not shown) may be fixedly secured therebetween.

The rectangularly shaped longitudinally extending channel 24A provided in the cover plate 19 and in the top wall 24 is adapted to receive a retaining member in a well-known manner. As the use of tire studs become more widely prohibited, the metal plate and recessed channel may be eliminated.

The arrangement of the lens member 30 with its peripheral transparent edge portion 33 and dividing ribs 34, and the underlying light-diffusing opaque support wall 25, imparts substantial daytime visibility to the pavement marker 10, rendering it of greater utility than prior markers.

In the illustrated embodiment, the area occupied by the peripheral edge portion 33 and the dividing ribs 34, is substantially coextensive in total area to that occupied by the retrodirective reflector elements 40 in those area circumscribed by the edge portion 33 and the dividing ribs 34.

Further, the use of the rectangular cells 35 and square reflector elements 40 permits the use of vertical sidewall surfaces in each recess 26 of the marker, if desired, whereby substantially the full width of the marker 10 is provided with complete reflective elements; moreover, use of the vertical sidewalls 23 and 24 and the vertical dividing wall portions 25A with the substantially vertically disposed parallel ridges 45 results in no loss of reflective area by the ridges 45 while permitting their orientation in the optimum direction for tire contact.

The opaque, light-diffusing base member 20 serves to reflect daylight impinging thereon to an observer. At a distance, the uniform spacing of the dividing ribs 34 and dividing wall portions 25A causes the pavement marker to appear as a substantially uniform reflective body, with the cells 35 tending to disappear to the eye of the observer under daylight conditions. Alternatively, under nighttime driving conditions, the uniform size and spacing of the cells 35 causes the pavement marker to appear as a uniform reflective member, the dividing ribs 34, which improve daytime visibility, tending to disappear under evening driving conditions.

Another and preferred form of abrasion-limiting means is illustrated in FIGS. 11 and 12. FIG. 11 depicts a fragmentary light receiving and refracting portion of the front face of a lens member 50, generally similar in plan configuration to the lens member 30, except the lens member 50 does not include the raised ridges 45 as are on the lens member 30. On the rear face of the lens member 50 there are reflex reflector elements 52 substantially identical to the reflector elements 40.

In this embodiment, the abrasion-limiting means comprises a thin sheet 55 of untempered glass.

The light receiving and refracting portion of the glass sheet 55 is bonded to the front face of the lens member 50 in at least those areas overlying the reflex reflector elements 52. To protect the perimeter edges of the glass sheet 55, the lens member 50 is provided with a raised lip 51 extending about the entire periphery of the glass sheet 55.

In the illustrated embodiment, the lens member 50 is provided with rear dividing ribs 53 so that a pavement marker 10 employing the lens member 50 will have substantially the same daytime and nighttime reflective characteristics as a pavement marker employing the lens member 30. While the glass sheet 55 is shown as covering those portions over the areas occupied on the rear face by the ribs 53, it should be understood that the lens member 50 could be provided with raised ridges 45, with a glass sheet being disposed between pairs of ridges 45, thereby utilizing both forms of abrasion-limiting means disclosed.

The glass sheet 55 may be adhesively bonded to the lens member 50 by first applying an adhesive coating to the glass sheet 55 or to the lens member 50 and then placing the glass sheet 55 in position on the lens member 50 with the adhesive therebetween. Alternatively, the glass sheet 55 may be bonded to the lens member 50 during molding of the lens member 50.

A detailed description of a preferred method for laminating the glass to the underlying substrate will be found in an application of Sidney A. Heenan, Robert M. Flanagan and Ramon J. Ascencio, Ser. No. 789,247, filed Apr. 20, 1977, and now abandoned, and a continuation thereof, Ser. No. 961,096, filed Nov. 16, 1978, both of which applications are and assigned to the same assignee as the present application.

A very thin sheet 55 of transparent glass is provided for lamination to the lens member 50, the glass sheet 55 preferably being untempered and having thickness in the range from about 2 mils to about 15 mils. A suitable glass is available from Corning Glass Works as Micro-Sheet (Glass Code 0211), Thickness Reference Nos. 00 to 3, and having an index of refraction of 1.523. The glass sheet 55 preferably is provided in a shape which is substantially the same as the shape of the front face of the lens member 50 and preferably has dimensions slightly larger than the optic portions of the lens so as to extend beyond the borders of the reflex areas and to the edges, or beyond, of the lens member 50, although in the illustrated embodiment, it is shown surrounded by the peripheral raised lip 51 on the lens member 50.

One side of the glass sheet 55 is coated with a silane solution and then allowed to dry, the silane solution serving to enhance the adhesion of the glass sheet 55 to adhesive materials. A suitable silane is available from Hughson Chemicals, Lord Corporation, as Chemlok #607, which is preferably reduced to a 16% solution in denatured ethyl alcohol (one part "607" to five parts denatured ethyl alcohol). Another suitable silane is Dow Corning's Z6020 silane, which is preferably reduced to a 0.4% solution in denatured ethyl alcohol (one part Z6020 to 250 parts denatured ethyl alcohol). Still another suitable silane is Union Carbide's A-1120 silane.

An adhesive material is applied to the light receiving and refracting portion of the front face of the lens member 50, the adhesive preferably being applied as a bead laid on the light receiving and refracting portion of the front face parallel to the long side of the front face and at least equal in length to the length of the glass. This shape of adhesive bead is preferable because in placing and pressing the glass in juxtaposition thereagainst, the bead will spread from the center outwardly in wave fashion and expel air before it to eliminate air bubbles therein. It has been found that the adhesive may preferably comprise a clear, radiation curable, acrylourethane based coating which is curable to form a transparent totally crosslinked matrix. Such a resin has been used as a coating or as a casting resin, but it has proved to be very effective as an adhesive between the acrylic lens members and the silane-coated glass sheets. A suitable acrylourethane resin is available from Hughson Chemicals, Lord Corporation, as Part #RD-2932-44. It also is possible to use other radiation curable resins such as acrylic based resins. One such satisfactory acrylic resin is Ren Plastics (a CIBA-GEIGY Company) product known as DA-560-4 U.V. Curable Adhesive.

While the urethane resin has been found to provide excellent adhesion to acrylic substrates such as methyl methacrylate or rubber-modified methyl methacrylate, its adhesion to polycarbonate substrates such as Lexan is not as strong. Accordingly, there is preferably added to the urethane resin 5% by weight of dimethylformamide (DMF), which has been found to afford good adhesion to polycarbonate without reducing the adhesion of the urethane resin to acrylics, and at the same time has served to reduce the tendency for the urethane resin to develop gas bubbles when heated, even though used with a methylacrylate reflector.

The glass sheet 55 is pressed gently against the adhesive bead, to form a layer 54 which covers the silane-coated side of the glass sheet 55 and the underlying portions of the lens member 50, this pressing also serving to drive all gas bubbles from beneath the glass sheet 55. The pressing of the glass sheet 55 against the adhesive is continued until the adhesive layer 54 provides a substantially continuous film between the glass sheet 55 and lens member 50, and preferably having a thickness in the range of from about 6 mils to about 15 mils, thereby forming a laminate wherein the glass sheet 55 is substantially centered over the reflex area of the lens member 50.

In use, the pavement markers will have to withstand a wide range of temperatures on the roadway, these temperatures typically ranging from −30° to +150° F. This causes the creation of considerable stresses in the materials since there is a substantial difference in the thermal coefficients of expansion of the glass sheet 55 and the acrylic or polycarbonate reflector or lens member 50. For example, the thermal coefficient of expansion of acrylic is approximately nine times that of the glass sheet. Therefore, the layer 54 of adhesive between the glass sheet 55 and the plastic lens member 50 must be sufficiently thick so that, once cured, it can accommodate the changes in size occasioned by the wide differences in the thermal coefficients of expansion. A preferred thickness it 6 mils but it has been found that a continuous adhesive layer with variable thickness, even down to 1 mil, will suffice for the temperature ranges normally experienced by pavement marker reflectors in service.

It has also been recognized that, once the urethane adhesive has been cured, as the temperature of the resulting laminate drops below the temperature at which curing occurred, the plastic reflector shrinks faster than the glass and places the glass sheet 55 in compression, and increases the strength of the laminate. Conversely, as the temperature is raised above the temperature at which curing occurred, the plastic reflector expands faster than the glass and places the glass sheet in tension, thereby significantly decreasing the impact resistance. More particularly, it has been found that if the laminate is later heated to a temperature between 10° F. and 20° F. above the curing temperature, the tensile forces alone will cause the glass sheet 55 to crack.

The glass-plastic laminate thereof is heated to a temperature of about 150° F. before curing, preferably by placing the laminate in a 150° F. oven for about 15 minutes. This preheating serves to enhance the adhesion of the silane coating on the glass sheet 55, which coating does not adhere as effectively at room temperature, and further serves to drive off volatile components from the adhesive and change it to a semi-solid state.

It is desirable to preheat the laminate to approximately the maximum temperature expected to be experienced by the pavement marker in service on the roadway so that the glass 55 will generally always be in compression during use, and to assure it will not be in tension, but it has been found that for methyl methacrylate a temperature of 180° F. causes distortion of the reflector, thereby resulting in serious degradation of the optical effectiveness of the reflector. Thus, the preheating temperature should be less than 180° F. If a polycarbonate is used, this temperature could be raised.

It has also been found that, while in general having the glass normally in compression in service tends to increase the impact resistance of the laminate, the adhesive layer is adversely affected if the compression gets too great. Thus, in very cold regions there could be problems with the stresses set up in the pavement markers when they have been cured at a very high temperature and then experience temperatures in the range of −30° F. Therefore, in order to minimize these difficulties, and because the maximum temperatures experienced in colder regions are typically less than those experienced in warmer climates, the laminate preferably is preheated to a temperature of only about 130° F. in the case of pavement markers (such as snowplowable markers) which are to be used in colder climates, as compared to the preferred temperature of 150° F. for markers to be used in warmer climates.

When the laminate has been heated to the preheat temperature, it is immediately exposed to radiation for curing the urethane resin adhesive before the laminate has had a chance to cool substantially from the preheat temperature. In the illustrated embodiment, radiation curing is achieved by an ultraviolet radiation system. Suitable curing of the adhesive has been accomplished by exposing it to the radiation from a 200 watt per linear inch, medium pressure, mercury vapor lamp at a distance of about 8 inches from the lamp for a time period of about 5 seconds.

While the adhesion of the silane coating on the glass sheet 55 is enhanced by the preheating so as to be effective to promote adhesion of the urethane adhesive to the glass sheet 55, the silane coating preferably requires subsequent heating to achieve maximum adhesion; although it will cure after an extended time period at room temperature, this curing time can be greatly accelerated by heating the laminate for a predetermined time period. Accordingly, after the urethane adhesive has been cured, the laminate is postheated in an oven at 150° F. for a time period of between 30 and 50 minutes. Preferably, the heating is at 150° F. for 30 minutes.

After the postheating step, in those instances where no lip 51 is used and the glass sheet 55 extends beyond the lens member 50, the excess portions of the glass sheet 55 around the edges thereof may be removed by being trimmed or knocked off with a suitable tool. The purpose of these overlapping edges is that the ultraviolet curing mechanism of the urethane adhesive is such that the resin is incompletely cured to a distance of approximately 0.040 inches from the surface exposed to the air, in this case the peripheral edges of the adhesive layer 54. In order to overcome this difficulty, it is normally recommended that a nitrogen inerting atmosphere or some sort of air barrier be utilized during the ultraviolet curing process. In order to obviate this precaution, the glass sheet 55 may be oversized so as to extend beyond the perimeter of the reflex area of the reflector face a distance at least as great as the air-inhibition distance so that, after curing, the portion of the glass sheet 55 overlying the incompletely cured adhesive around the perimeter of the adhesive layer 54 may simply be removed, so that there remains a glass sheet 55 which completely covers the reflex area and is securely adhered thereto over the entire area thereof by a fully cured adhesive so as to avoid chipping or delamination of the glass sheet in service. After the excess portions of the glass sheet 55 are trimmed off, the edges of the sheet 55 preferably are ground to smooth them. If desired, the oversize portion of glass sheet 55, if not large, may be left on the marker where vehicle tire contact will chip it down to the point where the adhesive binds the glass to the underlying substrate.

It has been found that pavement markers such as the type disclosed herein, or of the type disclosed in U.S. Pat. No. 3,332,327 Heenan, when provided with a glass overlay of the present invention, have a retained reflectivity, or improved optical efficiency, in the range of 12 to 56 times that of unmodified markers of the same types, when exposed to the same conditions.

Furthermore, it has been found that the addition of the glass sheet 55 to the pavement marker serves to increase the initial reflectivity, i.e., markers modified with the glass overlay of the present invention have exhibited initial specific intensities as much as 50% greater than unmodified markers of the same type. It is believed that this phenomenon results from the fact that normally the light receiving and refracting portion of the front face of the lens member 50, while substantially flat and planar, has minute waves or depressions therein. It is believed that the adhesive layer 54 by which the glass sheet 55 is secured to the lens member 50 serves to fill these waves and even them out, thereby enhancing the optical performance of the reflector. The light receiving and refracting portion of the front face of the lens member in both illustrated embodiments is disposed at an angle of approximately 45° to the horizontal surface 21 and the roadway surface, while the support wall 25 is inclined at an angle of approximately 41°. The ridges 45 the lens member 30 are positioned at angles of approximately 53° relative to the horizontal surface 21 and similarly the side edges 27 and 28 forming extensions of the sidewalls 22 and 23 also are inclined at angles of approximately 53° relative to the underlying surface 21. It will be apparent from the foregoing that the outer edges of the ridges 45 and the side edges 27 and 28 therefore are substantially coplanar and define a barrier plane which provides a protective area for the lens member 30. The ridges 45 may have a width or thickness of approximately 0.07 inches, a height above the light receiving and refracting portion of the front face 31 of approximately 0.06 inches, and the side surfaces of the ridges are inclined with respect to the vertical at draft angles of approximately 5°.

The base member 20 may be made of acrylonitrile butadeine styrene (commonly known as ABS), glass-filled ABS, methyl methacrylate or rubber-modified methyl methacrylate or Lexan; while the lens members 30 and 50 may be of methyl methacrylate or a rubber-modified methyl methacrylate or a polycarbonate such as Lexan.

Normally, the lens member and the base member will be chosen to provide the same colors, day and night, with the specific color being determined by the specific function of the marker, e.g. lane delineation vs. median edge delineation.

The embodiment of the pavement marker illustrated in FIG. 10 is primarily intended to be used independently of any metal housing or casting. In that embodiment the top wall 24, rather than being generally horizontal, as in the first embodiment illustrated in FIG. 1, instead has surfaces 47 and 48 which incline upwardly in the same general direction as the support walls 25, the inclined surfaces 47 and 48 forming a crown above the height of the lens member to provide additional reflective body area for reflecting daylight back to an observer. The metal cover plate 19 would of course not be used with this marker which would preferably be used under non-snowplowable conditions.

The above detailed description is provided by way of example only. Various details of design and construction may be modified without departing from the true spirit and scope of the invention as defined in the appended claims.

What is claimed is:

1. In a pavement marker providing a marking on a roadway surface, the marking being visible from an oncoming vehicle on the roadway, the pavement marker including means to position the marker relative to the associated roadway surface, and including a lens member of light-transmitting synthetic resin having a front face inclined at an angle of at least 15° to the associated roadway surface and a rear face having reflex reflective means on at least a portion thereof for reflecting light transmitted through said front face back toward the source thereof, the improvement comprising a thin sheet of untempered glass having a thickness no greater than about 15 mils fixedly disposed on said front face of said lens member at least in a portion of the areas overlying the reflex reflective means on the rear face of said lens member, said glass sheet being in compression throughout the expected temperature range to which the pavement marker is exposed in use, said glass sheet reducing the degradation of optical efficiency normally caused by abrasive tire contact on said lens member while allowing adequate cleaning of said pavement marker by tire-wiping action whereby the optical efficiency of said pavement marker is enhanced.

2. The invention set forth in claim 1, wherein the thickness of said glass sheet is about 5 mils.

3. The invention set forth in claim 1, wherein said glass sheet is adhesively bonded to said lens member and said adhesive is in the range of between 1 mil and 15 mils in thickness, thereby to accommodate relative changes in size of the glass sheet and the lens member material in use resulting from the different thermal coefficients of expansion thereof.

4. The invention set forth in claim 3, wherein said adhesive comprises a radiation-curable acrylourethane based resin.

5. The invention set forth in claim 1, wherein said glass is in the form of a thin sheet having a thickness of about 5 mils, said glass being adhesively bonded to said lens member, said adhesive bond being in the range of between 6 mils and 15 mils in thickness.

6. The invention set forth in claim 1, wherein said pavement marker includes a base member and said lens member of light-transmitting synthetic resin is fixedly secured to said base member, means cooperating with the rear surface of said lens member for providing a plurality of dividing walls defining hermetically sealed cells in conjunction with said rear surface, a plurality of retrodirective cube-corner type reflector elements on said lens member in the portions thereon occupied by said cells for reflecting light impinging upon the front face of said lens member in the areas corresponding to said cells back toward the source thereof, to render said reflector structure highly visible at night, said glass sheet overlying said lens member at least in a portion of the areas occupied by said reflector elements.

7. The invention as set forth in claim 1, wherein said glass sheet is no greater than about 15 mils in thickness and is adhesively bonded to said lens member, said adhesive being in the range of between about 1 mil and 15 mils in thickness thereby to accommodate relative changes in size of the glass sheet and the lens member material in use resulting from the different thermal coefficients of expansion thereof, while maintaining said glass in compression throughout the expected temperature use range of the marker.

8. The invention set forth in claim 1, wherein said glass sheet is between about 2 mils and about 15 mils in thickness and is adhesively bonded to said lens member, said adhesive being in the range of between about 1 mil and 15 mils in thickness thereby to accommodate relative changes in size of the glass sheet and the reflector material in use resulting from the different thermal coefficients of expansion thereof, while maintaining said glass in compression throughout the anticipated temperature use range of the marker.

9. The invention as set forth in claim 8, wherein said glass sheet is about 5 mils thick and said adhesive is about 6 mils thick.

* * * * *

UNITED STATES PATENT AND TRADEMARK OFFICE

CERTIFICATE OF CORRECTION

PATENT NO. : 4,232,979

DATED : November 11, 1980

INVENTOR(S) : Glenn W. Johnson, Jr. and Sidney A. Heenan

It is certified that error appears in the above-identified patent and that said Letters Patent are hereby corrected as shown below:

Column 1, line 56, after "reflex" insert --reflective--

Column 3, line 43, "ange" should read --angle--

Column 5, line 11, "Ser. No. 798,249" should be --Ser. No. 789,249--

Column 7, line 62, insert degree symbol so that "30" reads --30°--

Column 9, line 26, "become" should read --becomes--

Column 10, lines 6 through 12, "The light . . . glass sheet 55." should read --The glass sheet 55 is bonded to the light receiving and refracting portion of the front face of the lens member 50 in at least those areas overlying the reflex reflector elements 52. To protect the perimeter edges of the glass sheet 55, the lens member 50 is provided with a raised lip 51 extending about the entire periphery of the glass sheet 55.--

UNITED STATES PATENT AND TRADEMARK OFFICE

CERTIFICATE OF CORRECTION

PATENT NO. : 4,232,979

DATED : November 11, 1980

INVENTOR(S) : Glenn W. Johnson, Jr. and Sidney A. Heenan

It is certified that error appears in the above-identified patent and that said Letters Patent are hereby corrected as shown below:

(continued)

Column 10, line 38, delete "and"

Column 11, line 63, "it" should read --is--

Column 12, line 15, "thereof" should read --therefore--

Column 12, line 26, after "glass" insert --sheet--

Column 13, line 63, after "45" insert --on the--

Signed and Sealed this

*Fourteenth* Day of *April 1981*

[SEAL]

*Attest:*

RENE D. TEGTMEYER

*Attesting Officer*

*Acting Commissioner of Patents and Trademarks*